US009769884B2

(12) United States Patent
Niklasson et al.

(10) Patent No.: US 9,769,884 B2
(45) **Date of Patent: *Sep. 19, 2017**

(54) VERSATILE MICROWAVE HEATING APPARATUS

(71) Applicant: WHIRLPOOL CORPORATION, Benton Harbor, MI (US)

(72) Inventors: Olle Niklasson, Finspong (SE); Hakan Carlsson, Norrkoping (SE); Ulf Nordh, Norrkoping (SE); Fredrik Hallgren, Kolmarden (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/139,629

(22) Filed: Apr. 27, 2016

(65) Prior Publication Data

US 2016/0242241 A1 Aug. 18, 2016

Related U.S. Application Data

(63) Continuation of application No. 13/150,335, filed on Jun. 1, 2011, now Pat. No. 9,332,597.

(30) Foreign Application Priority Data

Jun. 4, 2010 (EP) ..... 10164960

(51) Int. Cl.

| | |
|---|---|
| ***H05B 6/66*** | (2006.01) |
| ***H05B 6/68*** | (2006.01) |
| ***H05B 6/64*** | (2006.01) |

(52) U.S. Cl.

CPC ..... *H05B 6/6482* (2013.01); *H05B 6/6402* (2013.01); *H05B 6/6447* (2013.01); *H05B 6/6494* (2013.01); *H05B 2206/044* (2013.01)

(58) Field of Classification Search

CPC .. H05B 6/6402; H05B 6/6447; H05B 6/6482; H05B 6/6494

(Continued)

(56) References Cited

U.S. PATENT DOCUMENTS

| | | | |
|---|---|---|---|
| 4,427,867 | A | 1/1984 | Dills |
| 4,499,356 | A | 2/1985 | Hatagawa |

(Continued)

FOREIGN PATENT DOCUMENTS

| | | | |
|---|---|---|---|
| EP | 0478086 | A1 | 4/1992 |
| GB | 2284133 | A | 5/1995 |

(Continued)

OTHER PUBLICATIONS

European Patent Application No. 10164960.6, filed Jun. 4, 2012, Applicant: Whirlpool Corporation. European Patent Publication No. 2393339A1, published Dec. 7, 2011.

*Primary Examiner* — Dana Ross
*Assistant Examiner* — Lindsey C Staubach

(57) ABSTRACT

A microwave heating apparatus for heating a load by means of microwaves is provided. The microwave heating apparatus comprises a cavity arranged to receive a piece of food to be heated, a first microwave supply system configured to supply microwaves at the cavity bottom for energizing a browning function in the cavity, a second microwave supply system configured to supply microwaves into the cavity for exciting cavity modes and a control unit configured to control the first and second microwave supply systems based on a food category and/or a cooking program. The first supply system comprises at least one microwave source and at least one antenna arranged in a lower part of the cavity and the second microwave supply system comprises at least one microwave source and at least one feeding port arranged in an upper part of the cavity. The present invention is advan- (Continued)

tageous in that a microwave heating apparatus with an improved crisp function is provided.

11 Claims, 3 Drawing Sheets

(58) Field of Classification Search
USPC ..... 219/702, 703, 715–717, 762
See application file for complete search history.

(56) References Cited

U.S. PATENT DOCUMENTS

| | | | | | |
|---|---|---|---|---|---|
| 4,816,632 | A | * | 3/1989 | Claesson | H05B 6/6402 219/750 |
| 5,179,264 | A | | 1/1993 | Cuomo et al. | |
| 5,204,503 | A | | 4/1993 | Maiellano, Jr. et al. | |
| 5,268,546 | A | * | 12/1993 | Berg | H05B 6/6411 219/728 |
| 5,272,302 | A | | 12/1993 | Dudley et al. | |
| 5,451,751 | A | | 9/1995 | Takimoto et al. | |
| 5,523,549 | A | * | 6/1996 | Tenzer | B42D 3/04 219/730 |
| 5,595,673 | A | | 1/1997 | Ekstrom et al. | |
| 6,077,454 | A | | 6/2000 | Tenzer | |

FOREIGN PATENT DOCUMENTS

| | | | |
|---|---|---|---|
| JP | 60235388 | A | 11/1985 |
| JP | 6193884 | A | 7/1994 |

* cited by examiner

VERSATILE MICROWAVE HEATING APPARATUS

CROSS REFERENCE TO RELATED APPLICATIONS

This application is a continuation of U.S. application Ser. No. 13/150,335, filed Jun. 1, 2011, now U.S. Pat. No. 9,332,597, issued May 3, 2016, which claims the benefit of European Patent Application Serial No. 10164960.6, filed Jun. 4, 2010, now EP Patent No. 2393339, granted Dec. 7, 2016, both of which are incorporated herein by reference in their entirety.

BACKGROUND OF THE INVENTION

The present invention relates to the field of microwave heating and, in particular, to a versatile microwave heating apparatus.

Field of the Invention

The art of microwave heating involves feeding of microwave energy into a cavity. Although the basic function of a microwave oven is to heat food by dielectric heating (i.e. via directly acting microwaves absorbed in the food), microwave ovens have been developed to include additional kinds of cooking capabilities, such as e.g. a crisp (or browning) function or a grill function, thereby enabling preparation of various types of food items and providing new culinary effects. Such additional kinds of cooking capabilities usually require additional components such as a browning plate or a grill element.

Description of the Related Art

An example of such a microwave oven is for instance described in U.S. Pat. No. 5,595,673, wherein the microwave oven comprises a magnetron, a browning plate acting as a bottom heater (on which the food is placed) and optionally an IR-radiating top heater, which all can be controlled via a control unit of the oven. The microwave oven comprises also a feeding system with an upper opening for supplying the directly acting microwaves and a lower opening for supplying microwaves under the bottom heater. Both openings are arranged in the right-hand lateral wall of the cavity.

A drawback of such prior art microwave ovens is that, while the design of a microwave oven may be optimized (or improved) for a specific function (usually the directly acting microwaves, also referred to as standard microwave heating in the following), this is often made at the detriment of another function (typically the crisp function). The crisp function of prior art microwave ovens is therefore usually not optimized. In addition, as the crisp function is obtained via the feeding system used for standard microwave heating, the performance of the crisp function may also significantly vary from one type of microwave oven to another.

Thus, there is a need for providing alternatives and/or new apparatuses that would overcome such drawbacks.

SUMMARY OF THE INVENTION

In one aspect of the invention a microwave heating apparatus has a cavity arranged to receive a piece of food to be heated. A first microwave supply system is configured to supply microwaves at the cavity bottom for energizing a browning function in the cavity, wherein the first microwave supply system comprises at least one microwave source and at least one antenna arranged in a lower part of the cavity. A second microwave supply system is configured to supply microwaves into the cavity for exciting cavity modes, wherein the second microwave supply system comprises one or more microwave sources and one feeding ports are arranged in an upper part of the cavity. A control unit is configured individually and separately control the first and second microwave supply systems and allow either or both the first and second microwave supply systems to be activated based on a food category or a cooking program.

BRIEF DESCRIPTION OF THE DRAWINGS

The above, as well as additional features and advantages of the present invention, will be better understood through the following illustrative and non-limiting detailed description of preferred embodiments of the present invention, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF THE EMBODIMENTS

Figure 1:
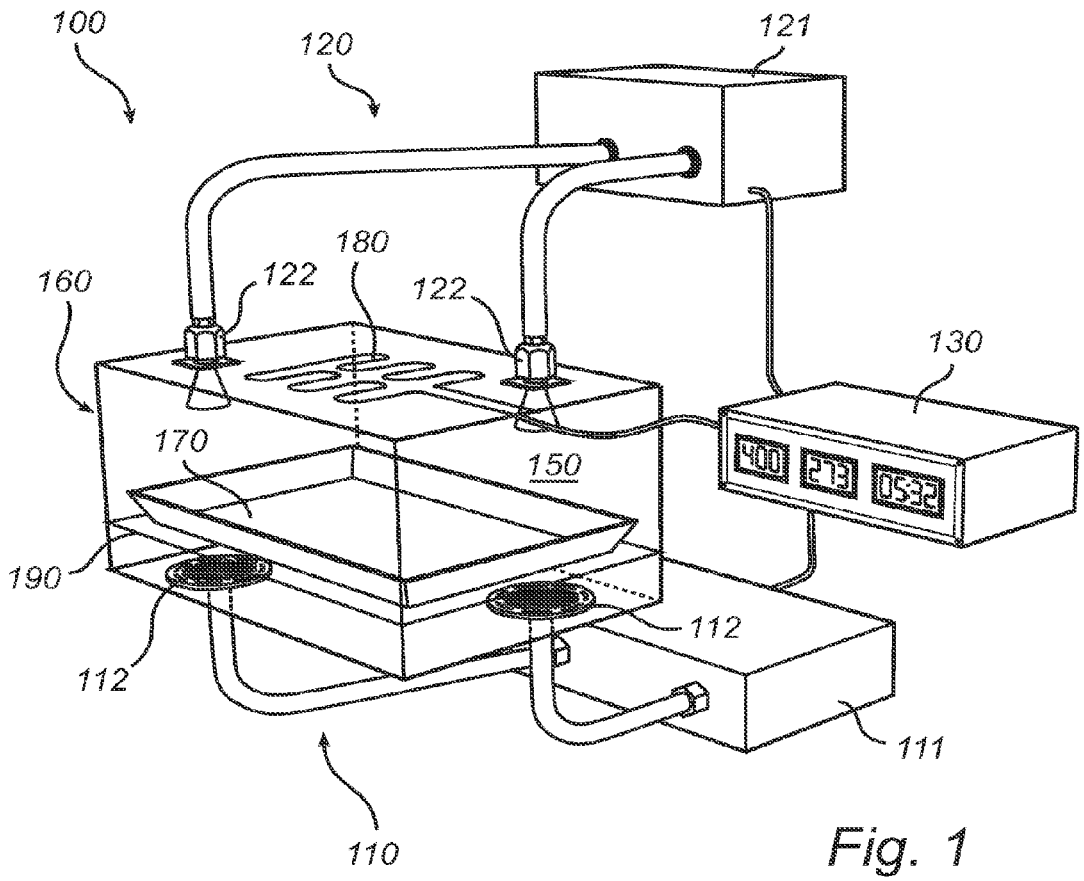
FIG. 1 schematically shows a microwave heating apparatus according to an exemplifying embodiment of the present invention.

With reference to FIG. 1, there is shown a microwave heating apparatus 100, e.g. a microwave oven, having features and functions according to an embodiment of the present invention.

The microwave oven 100 comprises a cavity 150 defined by an enclosing surface or external casing 160. The cavity 150 is arranged to receive a piece of food to be heated and, in particular, may be equipped with a bottom shelf 190 for receiving the piece of food or an accessory 170 containing the piece of food. The bottom shelf 190 may for instance be made of glass.

The microwave oven further comprises a first microwave supply system 110, a second microwave supply system 120 and a control unit 130 configured to control the first and second microwave supply systems 110 and 120 based on a food category and/or a cooking program.

The first supply system 110 comprises at least one microwave source 111 (or a generating block comprising a plurality of microwave sources) and at least one antenna 112 arranged in a lower part of the cavity, e.g. at the cavity bottom or at the bottom of the side walls of the cavity, for supplying microwaves under the bottom shelf 190. The first microwave supply system 110 is configured to supply microwaves at the cavity bottom for energizing a browning function in the cavity, i.e. such that a browning function is provided using a crisp or browning plate 170 arranged on the bottom shelf 190. Advantageously, the antennas are arranged such that a suitable electromagnetic field is provided between the bottom of the cavity 150 and the crisp or browning plate 170 for feeding the sole of the plate 170 with energy. More specifically, the antennas are configured such that the electric field vector is directed substantially perpendicular to the sole of the browning plate 170.

The crisp or browning plate 170 usually comprises a microwave absorbing layer arranged in thermal contact with another layer having relatively good thermal conductivity. In particular, the antennas are preferably arranged such that the magnetic field vector of microwaves fed into the cavity is directed substantially along the microwave-absorbing layer in order to generate magnetic losses in the layer and thereby heat the crisp or browning plate 170. The microwave-absorbing layer corresponds to the underside (or the sole) of the crisp or browning plate 170 and the piece of food can be browned on the thermally conductive layer, i.e. at the upper side of the browning plate 170. Generally, the upper side of the crisp or browning plate may consist of an aluminum (or steel) plate which has small thermal mass and good thermal conductivity and possibly a non-stick coating. In the present specification, no particular distinction is made between a crisp plate and a browning plate and reference to a crisp plate in the following could equally be made to a browning plate and vice versa.

The underside of the crisp plate is provided with a microwave-absorbing layer which may be rubber-embedded ferrite (in a proportion of about 75% ferrite and 25% silicon dioxide). The ferrite material has a Curie point at which absorption of microwaves in the material ceases. The characteristics for absorption of the microwaves in the ferrite material may be varied by altering the thickness of the layer and/or the composition of the material. Generally, the temperature of the upper side of the crisp plate that comes into contact with the piece of food stabilizes in a temperature range of 130-230° C.

The second microwave supply system 120 is configured to supply microwaves into the cavity 150 for exciting cavity modes. The second supply system 120 comprises at least one microwave source 121 and at least one feeding port 122 arranged in an upper part of the cavity 150. The feeding ports 122 may be arranged at, in principle, any of the walls of the cavity 150 such as a side wall or the ceiling. However, there is generally an optimized location of the feeding port for a predefined cavity mode structure. In the example shown in FIG. 1, two feeding ports 122 are used and both feeding ports are arranged at the ceiling of the cavity 150, thereby providing standard microwave heating by direct absorption of microwaves in the piece of food.

Further, the microwave oven 100 comprises a control unit 130 for controlling the first and second microwave supply systems 110 and 120. The control unit 130 acts as a shared control system for the first and second microwave supply systems 110 and 120 and is configured to control them based on a food category or cooking program. The control unit 130 may determine which of the microwave supply systems 110 and 120 is to be activated and according to which mode of operation. The determination of the operation mode by the control unit 130 may be realized by means of algorithms that optimize, or at least improve, the balance between different energy sources, for example the balance between microwave heating via the crisp function at the bottom of the cavity and standard microwave heating via the feeding ports at the ceiling of the cavity.

According to an embodiment, a food category may correspond to a specific type of food, such as e.g. a pizza or French fries thereby defining, on the one hand, a type of food which is compact and may cover a relatively large area of the bottom shelf 190 and, on the other hand, a type of food which is dispersed in the form of elongated pieces. Further, a food category may also comprise the state of the piece of food, e.g. frozen, thawed or liquid. A type of food category may therefore also be beverage.

According to an embodiment, a cooking program may be at least one of defrosting, frying, grill, baking, roasting, standard heating and upper browning. Depending on the cooking program and/or food category, the control unit 130 can determine an appropriate mode of operation for heating and control the first and second microwave supply systems 110 and 120 accordingly.

The first and second microwave supply systems 110 and 120 may be controlled individually, thereby allowing that both or just one of them is activated depending on the type of cooking program or food category.

Further, the control unit 130 may be configured to separately control the properties (such as frequency, phase and power) of the microwaves transmitted into the cavity 150 by either one of the first and second microwave supply systems 110 and 120.

Optionally, the control unit 130 may also be connected to sensors, such as field sensors or temperature sensors, for monitoring the conditions in the cavity 150 and, then, control the microwave supply systems 110 and 120 based on the information provided by the sensors during the heating procedure.

According to an embodiment, the oven may also be equipped with other heat sources, such as a grill element 180 or a heating source based on force convection (or convection and steam), for providing an additional source of heating and thereby increasing the cooking capability of the microwave heating apparatus 100. Advantageously, the grill element 180 may be arranged in the ceiling of the cavity 150. The grill element may for example be a so-called "grill tube", a quartz tube, a halogen-radiation source or an IR-radiating heater.

The control unit 130 may therefore act as a shared control system for the first and second microwave supply systems 110 and 120 and for any additional heat source, such as the grill element 180. The control unit 130 may then be configured to control these various sources based on the food category or cooking program according to a mode of operation.

Figure 2:
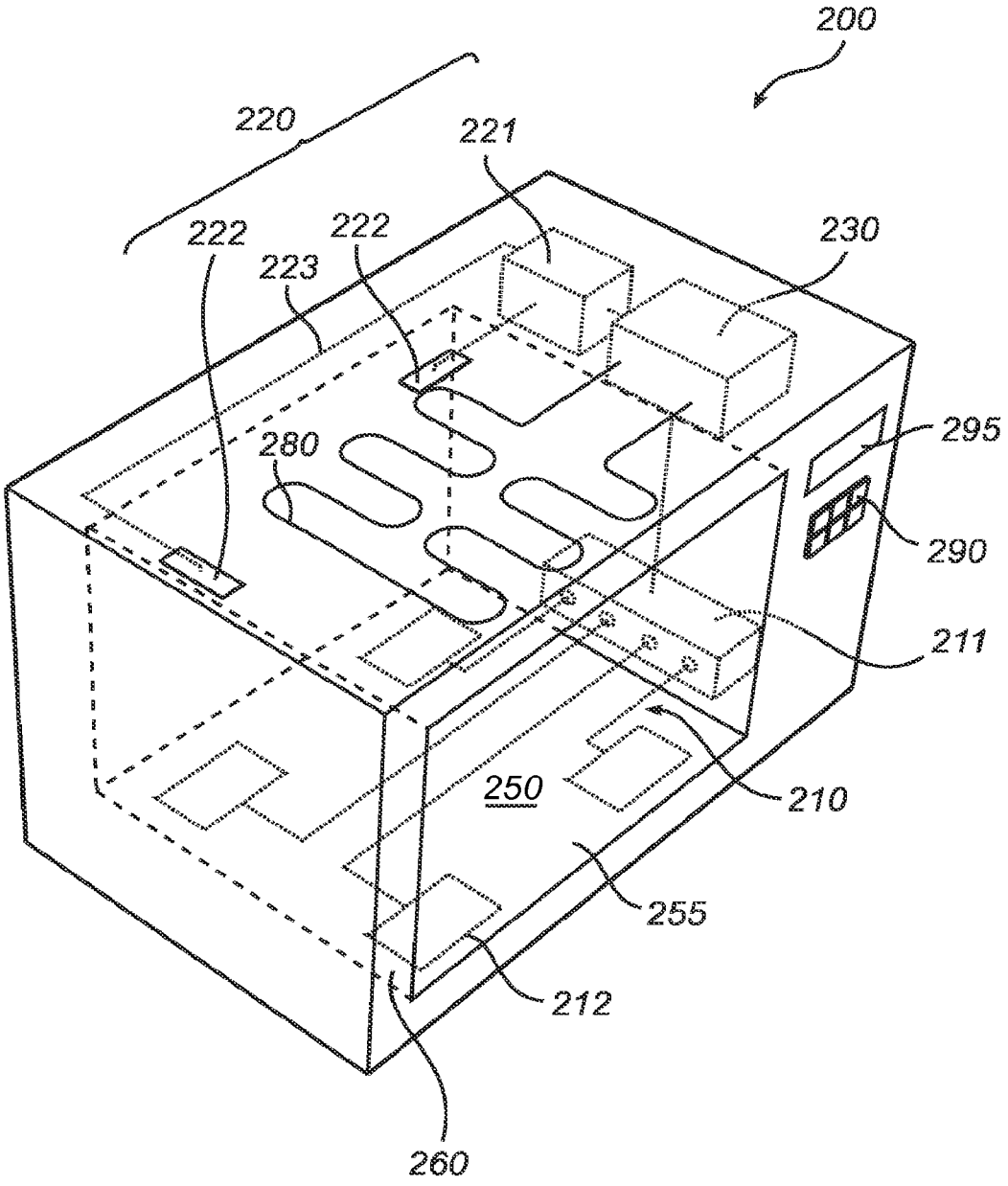
FIG. 2 schematically shows a microwave heating apparatus according to another exemplifying embodiment of the present invention.

The control unit 130 may in particular be configured to control the microwave generators 111 and 121 (e.g. their power) of the first and second microwave supply systems 110 and 120 and any power supply connected to the grill element 180. With reference to FIG. 2, there is shown a microwave heating apparatus 200, e.g. a microwave oven, having features and functions according to another embodiment of the present invention.

The microwave oven 200 comprises a cavity 250 defined by an enclosing surface or external casing 260. One of the side walls of the cavity 250 may be equipped with a door 255 for enabling the introduction of a load, e.g. a food item, in the cavity 250.

In the microwave oven 200, the cavity 250 is also provided with two feeding ports 222 through which microwaves generated by the microwave source 221 (e.g. a magnetron or a solid-state microwave generator) of the second microwave supply system 220 can be fed. Each of the microwave feeding ports 222 of the cavity 250 is connected to the microwave source 2210f the second microwave supply system 220 by means of a transmission line 223. The transmission line 223 may be a waveguide, a coaxial cable or a strip line. In the example shown in FIG. 2, regular waveguides may be used as transmission lines and the apertures may be of the same size as the waveguide cross-section. However, this is not necessarily the case and a multitude of other arrangements can be used such as, e.g., E-probes, H-loops, helices, patch antennas and resonant high-E bodies arranged at the junction between the transmission line 223 and the cavity 250. Optionally, the microwave oven 200 may also comprise switches (not shown), each being associated with a feeding port 222 arranged in the transmission line 223 for stopping the feeding of a respective feeding port.

Optionally, the microwave oven 200 may also comprise a grill element 280 arranged at the ceiling of the cavity 250.

The main features and functions of the microwave oven 200 of FIG. 2 are identical to the main features and functions of the microwave oven 100 described with reference to FIG. 1. In particular, the microwave oven 200 comprises a first microwave supply system 210 for providing a browning function at the bottom of the cavity 250 (via a number of distributed antennas 212), a second microwave supply system 220 for excitation of cavity modes and a control unit 230 for controlling the first and second microwave supply systems 210 and 220. In addition, FIG. 2 explicitly shows a user interface for selection of a food category or cooking program.

In particular, the user interface may comprise a display or control panel 295 which may show symbols or plain-text messages for selection of a food category or cooking program and for verification of the selections. Optionally, the display 295 may also show the remaining cooking or heating time during the cooking procedure, i.e. provide information on how the cooking or heating proceeds.

Further, the user interface may comprise at least one control button 290 or knob for entering information about the food category corresponding to the piece of food to be heated and/or information about a desired cooking program.

Alternatively, the user interface may comprise a touch screen enabling both entry and display of information.

The user interface may preferably be in communication with the control unit 230 such that the entered information can be processed by the control unit 230. The control unit 230 may then start a preprogrammed mode of operation in accordance with the entered information for implementing the desired cooking program.

The microwave oven 200 comprises at least two microwave supply systems 210 and 220 connected to the control unit 230. In particular, the control unit 230 may be configured to regulate the respective power of the first microwave supply system 210, the second microwave supply system 220 and/or the grill element 280 on the basis of a cooking program or food category selected (or input) via the user interface. Based on the entered information, the control unit 230 may for instance use a look-up table for matching the entered information with parameters already stored in the lookup table and thereby retrieving an appropriate mode of operation for controlling the first and second microwave supply systems 210 and 220. The use of a look-up table is advantageous in that the microwave heating apparatus can itself retrieve the appropriate mode of operation (with details on, e.g., which types of heat source is to be activated, at which power level and for which period of time) based on information (facts) entered by a user via the user interface without the need of estimation by the user.

For example, if the information entered by the user (i.e. the selected food category) corresponds to a deep-frozen pizza, the preprogrammed operation mode may include a sequential and/or simultaneous operation (or a combination of sequential and simultaneous operation) of the grill element, the standard microwave heating in the upper part of the cavity and the crisp function at the bottom of the cavity. Each of these three types of heat sources will provide a specific culinary effect which will result in an efficient and appropriate preparation of the deep-frozen pizza. In this specific example, the grill element is activated to provide the right color and melting of ingredients on top of the pizza, the crisp function is activated for providing the right consistence of the food and the standard microwave heating provides heating and preparation of the core of the deep-frozen pizza.

In another example, if the pizza was not deep-frozen but already prepared and stored in a fridge, activation of the grill element and the crisp function would be sufficient for warming up the pizza.

In another example, if the cooking program is selected to be "frying", the control unit 230 may be configured to only activate the first microwave supply system 210 (for the underneath crisp function) and the top grill element 280 (for the grill function), thereby frying the piece of food arranged in the cavity.

The user interface may therefore enable selection of various types of food category and cooking program such that a specific food category and cooking program can be retrieved in the look-up table, thereby activating the heat sources in accordance with a specific mode of operation.

Optionally, the microwave heating apparatus may also comprise a sensor (not shown) configured to detect if a browning plate is present in the cavity 250 or, alternatively, detect on which kind of plate the piece of food is placed. The control unit 230 may then be configured to activate the first microwave supply system 210 if a browning plate is detected. However, depending on the desired cooking program and/or food category, it may also be preferable to activate the first microwave supply system 210 even if no browning plate is detected.

FIG. 2 illustrates also that the first microwave supply system 210 may comprise a plurality of microwave sources and antennas 212 distributed at the bottom of the cavity, thereby improving uniformity of the crisp function and reducing the need of rotation of the crisp plate. In FIG. 2, the microwave source 2110 f the first microwave supply system 210 is represented by a single generator block comprising four separate microwave sources, each of those being connected to a specific antenna. The antennas may be H-loop or patch antennas or any combination of such antennas.

According to an embodiment, the microwave sources of the first and second microwave supply systems 110, 120, 210 and 220 may be solid state based microwave generators. In addition to the possibility of controlling the frequency of the generated microwaves, the advantages of a solid-state based microwave generator comprise the possibility of controlling the output power level of the generator and an inherent narrow-band feature. The frequencies of the microwaves that are emitted from a solid-state based generator usually constitute a narrow range of frequencies such as 2.4 to 2.5 GHz. However, the present invention is not limited to such a range of frequencies and the solid-state based microwave sources 111, 121, 211 and 221 could be adapted to emit in a range centered at 915 MHz, for instance 875-955 MHz, or any other suitable range of frequency (or bandwidth). The present invention is for instance applicable for standard sources having mid-band frequencies of 915 MHz, 2450 MHz, 5800 MHz and 22.125 GHz.

Figure 3:
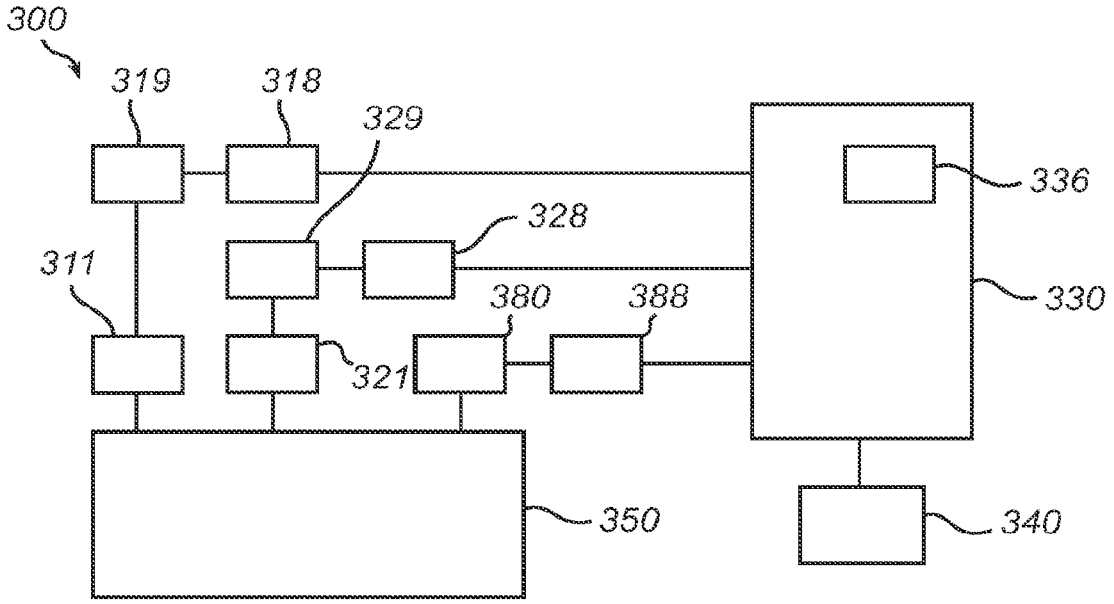
FIG. 3 shows a block diagram illustrating the functional units of a microwave heating apparatus according to an exemplifying embodiment of the present invention.

With reference to FIG. 3, there is shown a block diagram illustrating the functional units of a microwave heating apparatus 300 in accordance with an embodiment of the present invention.

The microwave heating apparatus 300 may be equivalent to any one of the microwave heating apparatuses 100 and 200 described above with reference to FIGS. 1 and 2, respectively.

The block diagram of FIG. 3 shows a control unit 330 (which may be the control units 130 or 230 described above with reference to FIGS. 1 and 2, respectively) comprising a microprocessor and a program store 336 for storing a look-up table comprising preprogrammed operation modes and parameters such as described above with reference to FIG. 2. Information about food category and cooking program may be inputted via the user interface 340, which may correspond to a touch screen or the display 290 and the control buttons 295 and any optional knob described above with reference to FIG. 2. Via a driver 318 and a microwave power unit 319, the control unit 330 can control the microwave source 3110 f the first microwave supply system (which may be equivalent to the first microwave supply systems 110 or 210 described above with reference to FIGS. 1 and 2, respectively) providing the crisp function. Similarly, via a driver 328 and a microwave power unit 329, the control unit 330 can control the microwave source 3210f the second microwave supply system (which may be equivalent to the second microwave supply systems 120 or 220 described above with reference to FIGS. 1 and 2, respectively) providing standard microwave heating by excitation of cavity modes. Further, via a driver 388, the control unit 330 can control the grill element 380 (which may be equivalent to any one of the grill elements 180 and 280 described above with reference to FIGS. 1 and 2, respectively) providing the grill function or top browning. The grill element 380 may also be a browning element, i.e. an element operated at a relatively lower power and mainly configured for browning (i.e. giving an adequate color) to the piece of food.

The control unit 330 may then control the various heat sources 311, 321 and 380 to optimize the heating or cooking of the piece of food introduced in the cavity in accordance with the food category and the desired cooking program. In particular, the control unit 330 may activate the heat sources according to a specific mode of operation, i.e. at adjusted power levels and for a suitable period of time during the cooking or heating procedure.

While specific embodiments have been described, the skilled person will understand that various modifications and alterations are conceivable within the scope as defined in the appended claims.

For example, although a cavity having a rectangular cross-section has been described in the application, it will be appreciated that the cavity of the microwave oven is not limited to such a shape and that it is also envisaged to implement the present invention in a cavity having a circular cross section or any other geometries describable in an orthogonal curve-linear coordinate system.

Further, although the grill element has been described in the application to be arranged at the ceiling of the cavity, it will be appreciated that the grill element may in principle be arranged at any wall of the cavity.

Further, although four antennas connected to four microwave sources, respectively, are shown in FIG. 2 for implementing the first microwave supply system, any number of antennas may be used such that a uniform crisp function at the bottom of the cavity is achieved or such that any shape of browning plates may be used without the need of rotation of the plate.

Further, although the second microwave supply system comprises two feeding ports in the embodiments described with reference to FIGS. 1 and 2, it will be appreciated that the second supply system may comprise a single feeding port or more than two feeding ports.

We claim:

1. A microwave heating apparatus comprising:

a cavity arranged to receive a piece of food to be heated;

a first microwave supply system configured to supply microwaves at a cavity bottom for energizing a browning plate in the cavity, wherein the first microwave supply system comprises at least one microwave source and at least one antenna arranged in a lower part of the cavity to energize the browning plate;

a second microwave supply system configured to supply microwaves into the cavity for exciting cavity modes, wherein the second microwave supply system comprises at least one microwave source and at least one feeding port arranged in an upper part of the cavity; and a control unit configured to individually and separately adjust the respective power levels of the first and second microwave supply systems and allowing either or both the first and second microwave supply systems to be activated based on one of a food category or a cooking program.

2. The microwave heating apparatus of claim 1, further comprising a user interface for selection of the food category or cooking program.

3. The microwave heating apparatus according to claim 1, wherein a food category corresponds to a specific type of food or state of food and wherein a cooking program includes at least one of the group comprising defrosting, frying, grilling, baking, roasting, volume heating or upper browning.

4. The microwave heating apparatus according to claim 1, wherein the microwave source of either one of the first and second microwave supply systems is at least one of a solid state microwave generator and a magnetron.

5. The microwave heating apparatus according to claim 1, further comprising a grill element arranged at a wall of the cavity for providing a grill function or top browning.

6. The microwave heating apparatus according to claim 5, wherein the control unit is configured to regulate the respective power levels of at least one of the first microwave supply system, the second microwave supply system or the grill element on the basis of a selected cooking program or food category.

7. The microwave heating apparatus according to claim 6, wherein the control unit is configured to activate only the first microwave supply system and the grill element if the cooking program is selected to be frying.

8. The microwave heating apparatus according to claim 6, further comprising a sensor configured to detect if the browning plate arranged to receive the piece of food is introduced in the cavity.

9. The microwave heating apparatus according to claim 8, wherein the control unit is configured to activate the first microwave supply system if the browning plate is detected.

10. The microwave heating apparatus according to claim 8, wherein the first microwave supply system comprises at least two pairs of microwave source and antenna distributed at the cavity bottom.

11. The microwave heating apparatus according to claim 8, further comprising at least one transmission line for feeding the microwaves generated by the microwave source of the second microwave supply system to the feeding port.

* * * * *